US010952465B2

(12) United States Patent
Alls

(10) Patent No.: US 10,952,465 B2
(45) Date of Patent: Mar. 23, 2021

(54) APPARATUS FOR MAKING CUTS IN CIGARS AND METHOD OF USE

(76) Inventor: Antonio Lee Alls, Palmetto, FL (US)

( * ) Notice: Subject to any disclaimer, the term of this patent is extended or adjusted under 35 U.S.C. 154(b) by 319 days.

(21) Appl. No.: 11/149,412

(22) Filed: Sep. 7, 2005

(65) Prior Publication Data

US 2007/0051382 A1 Mar. 8, 2007

(51) Int. Cl.
*A24F 13/26* (2006.01)

(52) U.S. Cl.
CPC ..... *A24F 13/26* (2013.01)

(58) Field of Classification Search
USPC ..... 131/253
See application file for complete search history.

(56) References Cited

U.S. PATENT DOCUMENTS

| | | | | | |
|---|---|---|---|---|---|
| 144,570 | A * | 11/1873 | Sickenberger | ..... | 131/253 |
| 483,077 | A * | 9/1892 | Miller et al. | ..... | 131/253 |
| 2,072,361 | A * | 3/1937 | Ehrig et al. | ..... | 131/274 |
| 6,854,471 | B1 * | 2/2005 | Sinclair, Jr. | ..... | 131/347 |

* cited by examiner

*Primary Examiner* — Phu H Nguyen
(74) *Attorney, Agent, or Firm* — Smith & Hopen, P.A.; Paul Murty

(57) ABSTRACT

Da Splitter" is a tool made of plastic, created to make adequate cuts in cigars and cigarillos to provide for additional material to be inserted to enhance the use of the cigar, cigarillos and other objects. Da Splitter was designed to make changing the flavor of a cigar quick and easy. With the razor to cut open the previous cigar, the pick to stuff the new one and a lighter attached to smoke your new flavored cigar this tool provides the convenience of three separate instruments in one.

7 Claims, 1 Drawing Sheet

ENGRAVE "MONOTYPE CORSIVA" STYLE
- DA SPLITTER
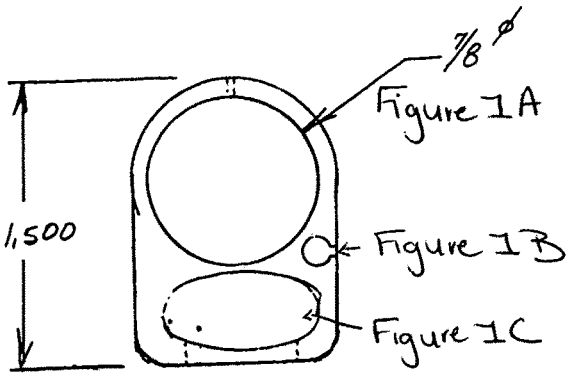
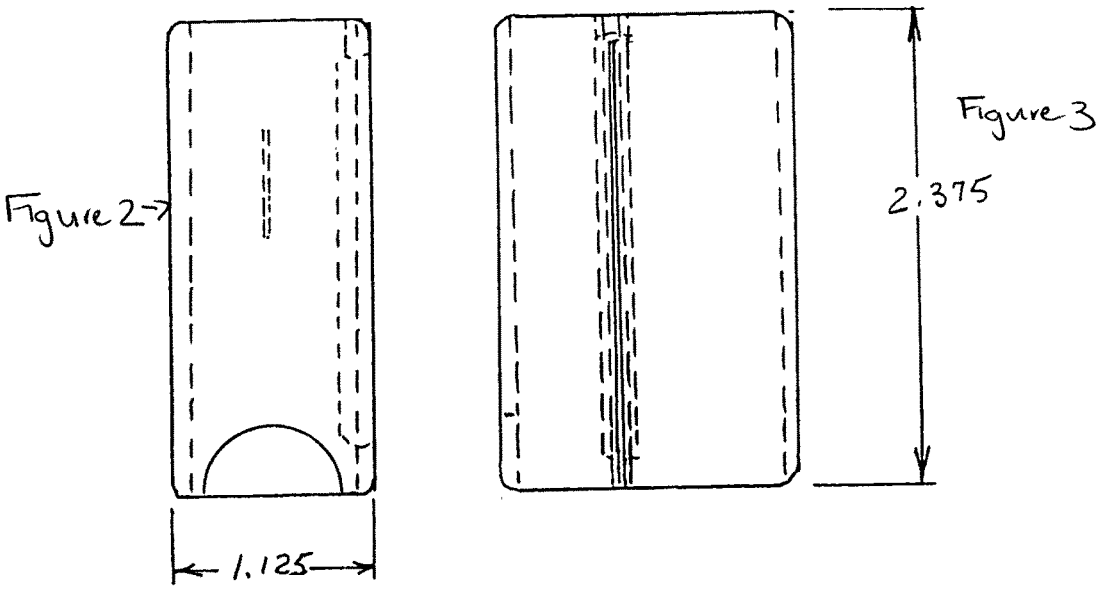
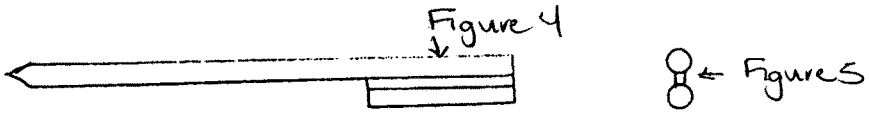

APPARATUS FOR MAKING CUTS IN CIGARS AND METHOD OF USE

BRIEF SUMMARY OF THE INVENTION

A tool was designed to make adequate cuts in cigars and cigarillos to provide for additional material to be inserted so that the flavor of the cigar or cigarillo may be enhanced.

DETAILED DESCRIPTION OF THE INVENTION

Use:

A tool created to make adequate cuts in cigars and cigarillos to provide for additional material to be inserted to enhance the use of the cigar, cigarillos and other objects.

Physical Description:

The tool comes in many different colors; it is made of hard plastic and has 3 compartments. The tool is round in the front and squares off in the back weighing approximately ½ lb. The round or front side has a ⅞" hole with a razor inserted and opens from both ends; this side of the tool is used to slide in the cigar. When the cigar is pulled through a cut is made down the middle from top to bottom. The backside of the tool is 1.125" wide and holds a mini cigarette lighter. Along the left side of the tool there is a 2.1" pick inserted; this pick is used for stuffing different flavor tobacco in the cigar.

How It's Made:

This tool is made through injection molding. Currently, the type of tool being used is soft with one cavity. The tool frame is FORTAL® and the cavity material is FORTAL®/steel. The exact material used to form the tool is impact styrene. It takes about 45 seconds to produce one prototype. Once the tool is dropped from the machine, the hobby blade in inserted by hand at a 25-degree angle. A sticker is placed across the front of the tool from one end to the other. The sticker has the name of the tool, a picture of the inventor and a warning label for the blade placed inside.

BACKGROUND OF INVENTION

Tobacco companies make several types of cigars in terms of size, type and flavor. However, all flavors are not available in all types or size. The tool was invented to cut open the cigar so that the customer of the cigar company may smoke any flavor out of any type one wishes. This invention was not designed to change, enhanced or out perform any prior invention.

BRIEF DESCRIPTION OF THE SEVERAL VIEWS OF THE DRAWING

FIG. 1A: A drawing of the tool shown from the top. Inserted in the hole of FIG. 1A is a hobby razor. This opening is from top to bottom and is used to slide the cigar through and in turn the cigar is split open.

FIG. 1B: This small opening is used to hold the pick (FIG. 4); which is used to stuff the cigar once the new flavor has been inserted.

FIG. 1C: The opening in this figure is also from top to bottom and is used to hold a cigarette lighter.

FIG. 2: This is the backside of the tool, flat and squared off on the corners.

FIG. 3: This is a side view of the tool.

FIG. 4: This is a view of the pick used to stuff the cigar.

FIG. 5: This is a small piece of plastic designed to keep the pick from falling out of the tool.

I claim:

1. A cigar cutting tool comprising:

a housing including a first opening disposed opposite a second opening, the housing including a body defined by a circumferential interior wall spanning between the first opening and the second opening; and a hobby razor disposed within the housing between the first opening and the second opening, a first end of the hobby razor secured to the circumferential interior wall, and a second terminal end of the hobby razor extending toward a central longitudinal axis of the housing spanning between the first opening and the second opening, wherein the housing is adapted to receive a cigar through the first opening, wherein the hobby razor is adapted to cut along a longitudinal length of the cigar, and wherein the housing is adapted to permit removal of the cigar through the second opening.

2. The cigar cutting tool of claim 1, further comprising:

a first aperture disposed in the housing proximate to the first opening, the first aperture disposed to receive an elongated pick therein, wherein the elongated pick is removable from the housing to insert an amount of tobacco into the cigar.

3. The cigar cutting tool of claim 2, wherein the first aperture extends along a longitudinal length of the body, such that a first end of the first aperture is disposed in the housing proximate to the first opening, and a second end of the first aperture is disposed in the housing proximate to the second opening.

4. The cigar cutting tool of claim 1, further comprising:

a second aperture disposed in the housing proximate to the first opening, the second aperture disposed to receive a cigarette lighter therein.

5. The cigar tool of claim 4, wherein the second aperture extends along a longitudinal length of the body, such that a first end of the second aperture is disposed in the housing proximate to the first opening, and a second end of the second aperture is disposed in the housing proximate to the second opening.

6. The cigar cutting tool of claim 1, wherein the first opening includes a diameter of ⅞ inches.

7. The cigar cutting tool of claim 1, wherein the second opening includes a width of 1⅛ inches.

* * * * *